United States Patent [19]

Fluent et al.

[11] Patent Number: 5,024,045

[45] Date of Patent: Jun. 18, 1991

[54] PANEL PACKAGING SYSTEM

[75] Inventors: Stewart L. Fluent, Cedar Falls; Colin Hart, Waterloo, both of Iowa; Charles D. McCree, King of Prussia, Pa.; Charles F. Lotsch, Audubon, Pa.

[73] Assignee: CertainTeed Corporation, King of Prussia, Pa.

[21] Appl. No.: 524,546

[22] Filed: May 17, 1990

Related U.S. Application Data

[63] Continuation of Ser. No. 317,744, Mar. 2, 1989, Pat. No. 4,941,309.

[51] Int. Cl.[5] ..... B65B 35/50; B65B 35/56

[52] U.S. Cl. ..... 53/443; 53/143; 53/252; 53/456; 53/544

[58] Field of Search ..... 53/462, 443, 531, 544, 53/143, 207, 209, 244, 252, 251, 250, 249

[56] References Cited

U.S. PATENT DOCUMENTS

| | | | |
|---|---|---|---|
| 3,491,506 | 1/1970 | Shiverdecker et al. | 53/458 |
| 3,808,770 | 5/1974 | Berney | 53/374 X |
| 3,835,620 | 9/1974 | Boltz et al. | 53/544 X |
| 4,173,106 | 11/1979 | Leasure et al. | 53/449 |
| 4,196,563 | 4/1980 | Gabrielson et al. | 53/456 |
| 4,358,918 | 11/1982 | Groom et al. | 53/252 X |
| 4,480,422 | 11/1984 | Meives et al. | 53/374 X |
| 4,499,704 | 2/1985 | Bacon et al. | 53/207 X |
| 4,686,813 | 8/1987 | Sawada | 53/544 X |

*Primary Examiner*—James F. Coan

*Attorney, Agent, or Firm*—Paul & Paul

[57] ABSTRACT

A vinyl siding panel package system is disclosed that prefolds corrugated paper blanks and then forms panel containers that are packed with a pre-specified number of panels. The panel packer receives a plurality of panels from a panel extrusion operator, re-orients panels into desired combinations and packs each combination, up to the limit, in a waiting container. The loaded container is sent to a container closing operation whereby the lid is sealed around the container body, and the container is weighed. A palletizer transports a loaded container from the closer to a waiting pallet.

2 Claims, 6 Drawing Sheets

PANEL PACKAGING SYSTEM

This application is a continuation of U.S. Pat. application Ser. No. 317,744, filed Mar. 2, 1989 for PANEL PACKAGING SYSTEM now U.S. Pat. No. 4,941,309.

BACKGROUND OF THE INVENTION

Vinyl siding is now very popular with construction companies and do-it-yourselfers. This siding has a competitive cost per sheet, or panel, and can be made by a known extrusion process to have a variety of shapes and colors. Horizontal siding panels, for instance, will normally be in 8-inch, double 5-inch or double 4-inch styles where the panels are 12 feet 6 inches long and about 9 inches wide overall. Vertical siding panels are made in 10-, 12-, and 16- inch wide pieces of varying lengths, with a typical size being 10 feet. Vinyl siding is sold in containers by "squares", where one square gives 100 square feet of coverage, and it is desirable to package the panels together so that one container carries two squares.

Modern extrusion machines can turn out a large volume of a desired style of panel per hour. Panels for use in the horizontal mode are sheets that can have a single or double bevel in their middle area (to give the appearance of clapboard when they are installed) and have at one, long edge a hanger strip with spaced-apart fastening holes through it and at the opposite, or butt edge, a small curled-in portion in the form of the hook on the letter "J" to interlock with adjacent panels. Although these physical features present attractive designs and allow for ease of installation of the panels, they also present problems to the siding manufacturer in that until the instant invention, the process of packaging two squares (of the variety of different styles and shapes) in a compact and efficient corrugated paper container and stacking the containers for shipment has been very labor intensive. Without the present invention, it may take as many as five workers to, in a timely fashion, correctly construct a proper size container, efficiently pack it with panels, seal it, weigh it and stack it on a waiting pallet. And, even after all of this human effort, the sizing and appearance of any one of the final packages may leave room for improvement.

It is an object of the present invention, therefore, to provide a vinyl panel packaging system that automatically matches panels in combinations to efficiently and compactly pack two squares of panels into a container with minimum human effort.

It is a further object of the present invention to systematically and securely construct panel containers from corrugated paper blanks to hold two squares of vinyl siding and have an efficient compact and, symmetrical outward appearance.

It is a still further object of the present invention to automatically match a pre-specified number of panels, as each is emitted from a panel extrusion process, to achieve a symmetrical package to facilitate efficient warehouse storage and handling and present a container of finest appearance.

It is a still further object of the present invention to automatically seal a container that has been automatically loaded with panels, weigh it and transport it to a pre-determined destination.

SUMMARY OF THE INVENTION

A vinyl siding panel packaging system is disclosed herein whereby individual specific panels are automatically matched into panel combinations and packed into a waiting container. Corrugated paper containers are systematically and uniformly constructed by a mechanized process from precut corrugated paper blanks. The blanks are mechanically folded along predetermined scorelines to break the corrugated paper uniformly at specific locations and thereby prepare the blanks for the next operation where they are then fed into an automatic container forming machine whereby electrically-powered mandrels fold end flaps together and automated glue guns apply a hot melt glue to specific surfaces thereof. Compression means in the form of camoperated pressure plates or electrically activated clamps force the end flaps together and apply a compressive force to these glued surfaces for a predetermined amount of time to construct a panel container with its lid section un-sealed. Each of these containers is then sequentially fed to a panel packing/container closing machine which is adjacent a vinyl siding panel extrusion line. As each panel issues from the cutter on the extrusion line, in a specific, flat horizontal orientation at a first speed, it is, slidingly grasped by roller pairs and moved at a second, faster speed to provide proper spacing between panels According to a predetermined control program sequence, each panel is automatically picked up by the panel packer, given a new, specific orientation, matched up in combination with another panel that has been emitted from the extrusion line and this combination packed into an open container After a predetermined number of panel combinations have been packed in the open container, the container is automatically moved through a final sealing operation whereby the container lid is folded on three sides and these sides secured to the container box, as by glueing and compression. The loaded container is then weighed and moved automatically to a waiting pallet.

Other features and advantages of the present invention will appear from the following description, taken in connection with the drawings, wherein

DETAILED DESCRIPTION OF THE PREFERRED EMBODIMENT

Figure 1:
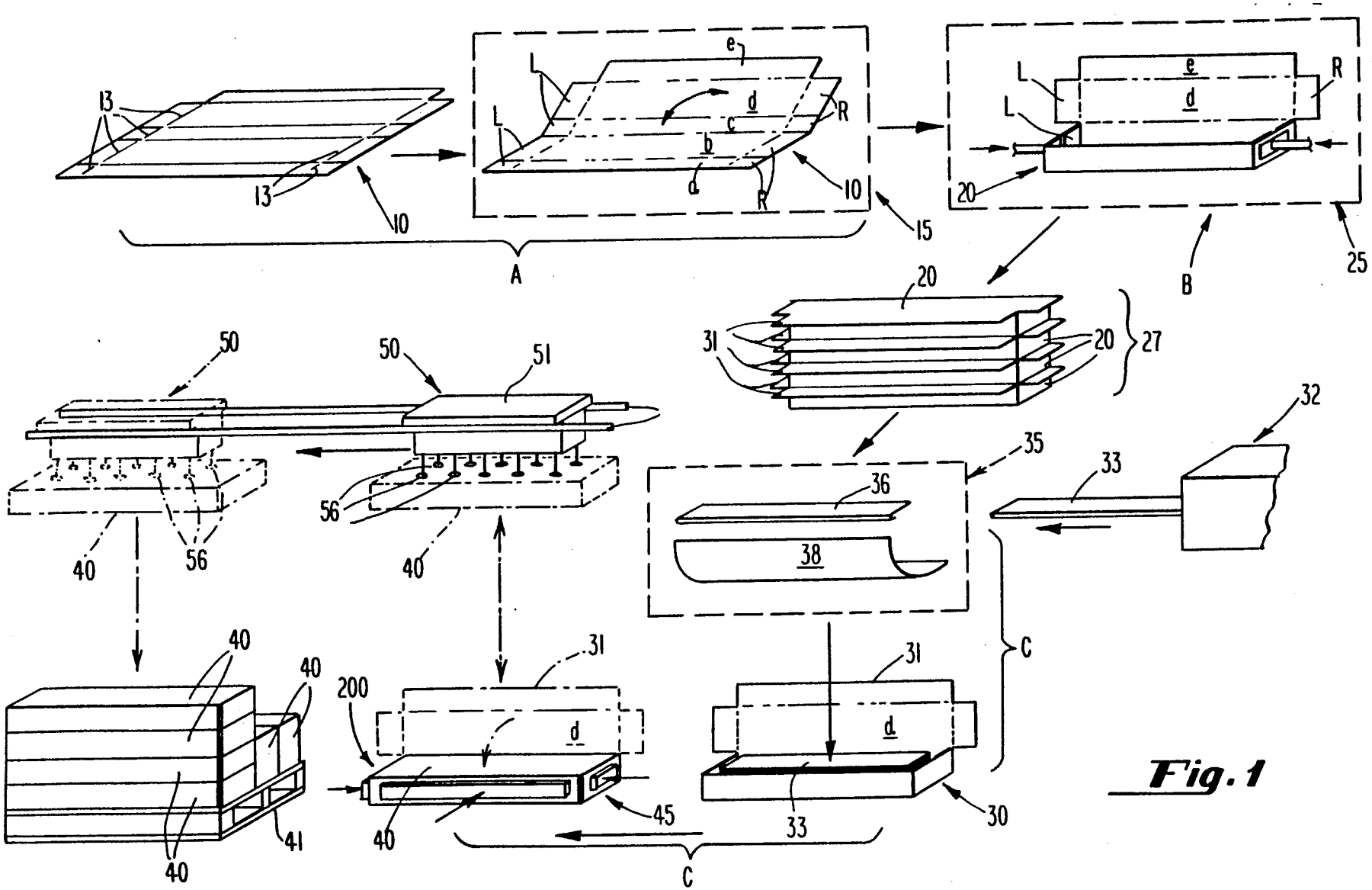
FIG. 1 shows a schematic representation of the functional areas of the panel packaging system.

The present invention accomplishes the aforementioned objects of the invention by utilizing precut, prescored corrugated paper blanks of pre-determined dimensions and with specific product information printed thereon and forming these banks into partially sealed panel containers. These partially sealed panel containers are automatically and sequentially fed in a lid-open position into a panel packer/container closer. The packer/closer receives individual panels from the extrusion operations and combines them in predetermined patterns, according to a computer control program, and then packs the combination into the open container. The open container is then automatically closed and fully sealed, by glueing the two end flaps and the front flap and applying pressure thereto, weighed, and then picked up and carried by the palletizer to a pallet. A pre-determined number of these loaded and sealed containers are automatically stacked in a pre-specified pattern, according to a computer control program, on a pallet for shipment to the end user. The panel packaging system of the present invention comprises four main areas: the container folding area; the container forming area; the panel packer/container closing area; and the container palletizing area. These four areas are shown diagramaticaly in FIG. 1 as A, B, C and D, respectively The arrows in FIG. 1 show either movement of a piece on or between machines or contact between part of the machine and the container.

The container blank folding area A contains a holding space for corrugated paper blanks 10 and a machine 15 that receives these corrugated paper blanks from the machine operator (shown schematically in FIG. 1) and prefolds them along three, predetermined scorelines. The purpose of prefolding each blank 10 is to assist the forming of a container in the forming and glueing operation in the next step, and to accomplish this a blank 10 is folded at the scorelines between the first four sections thereof As seen in FIG. 1, corrugated paper blank 10 is a flat, substantially rectangular sheet of material that has a top surface and a bottom surface with pre-cut score lines 12, as is known, on the top surface between sections a, b, c, d, and e, thereof. Sections a, b, c, and d each have left-end and rightend flaps L, R, respectively, separated by pre-cut score lines 13 that run substantially perpendicular to the first-mentioned lines. The prefolding operation breaks the cardboard between sections a and b, b and c, and c and d. In this operation, the score line 12 between sections d and e is not broken, nor are the score lines 13 between sections a through e and their respective end flaps L or R.

The panel container folding machine 15 accepts corrugated paper blanks 10 with nominal lengths of ten foot, twelve foot, and twelve foot six inches and with widths and heights thereof limited only by internal machine clearances as the blank is prefolded. Folding machine 15 is provided with 460 VAC, 3-phase electric service and an air service that provides between 15 and 150 psig to various machine parts. It is also used to generate vacuum between 12" and 24" of mercury for vacuum accessories. Machine 15 is comprised of a work area that consists of a generally horizontal surface area raised up to a comfortable, predetermined height for the operator and which has a clear shield in the form of a large, open-ended box, separated from the work area by a thin space that will allow insertion of a new blank 10, which is placed over the surface to prevent injury to the operator's hands or arms. Machine 15 has a left hand guide for initially positioning blank 10 on the work surface area and a pair of sensors, such as optical or proximity sensors, to send a signal that blank 10 is properly positioned. Machine 15 also has a folding platform with locators to forcibly restrict a section, such as Section a, or b, of blank 10 while the folding hinged platform breaks the scoreline and make a fold for forming the container Once the folding table makes the fold, a vacuum operated suction cup releasably holds the adjacent section of blank 10 while the folding table returns back to its initial position to maintain the container blank in a generally flat configuration. A master power button is connected into the circuitry to allow machine 15 to be turned on or turned off at one location and a master air service switch enables the air and vacuum at planned times. When the operator has broken blank 10 at the three scorelines, an eject button is pressed to disable all sensors, the locators, the folding arm, and the vacuum cup to allow the prefolded container to be removed.

Area B in the packaging system is where prefolded blank 10 is formed into a lid-open container 20 in the container former machine 25 and a plurality of stacker containers are then moved to the next area After each prefolded blank 10 is removed from machine 15, it is individually carried to a work surface in machine 25. The work surface area is a predetermined height above the floor. Once the machine operator determines that a prefolded blank 10 has been properly set therein, an automatic glueing and securing cycle is initiated. In this cycle, a pair of cylinder-operated pressure plates operate to clamp the prefolded container blank against a preset position on the work surface area to bring sections a and c perpendicular to section b. Section a and c left and right end flaps are folded to form a right angle therewith and a pair of hot melt glue guns, connected via tubes to a source of glue, automatically apply hot melt glue to the top surfaces of the left and right end flaps of section b. The left and right minor end flaps of sections a and c are compressed thereagainst by electrically-activated mechanical clamps and a timer holds a set period of time for the glue to set. At the end of this compression time, the compression devices that have been forcing the left and right end flaps together are removed and a formed, lid-open panel container 20 is removed from the work area. Panel containers 20 are stacked one on top of another and moved to area C, as by a wheeled cart, to the container storage and transfer section 300 of the panel packer/tray closer 35 for packing with a predetermined number of panels 33, as each issues from extrusion operations 32.

Figure 2:
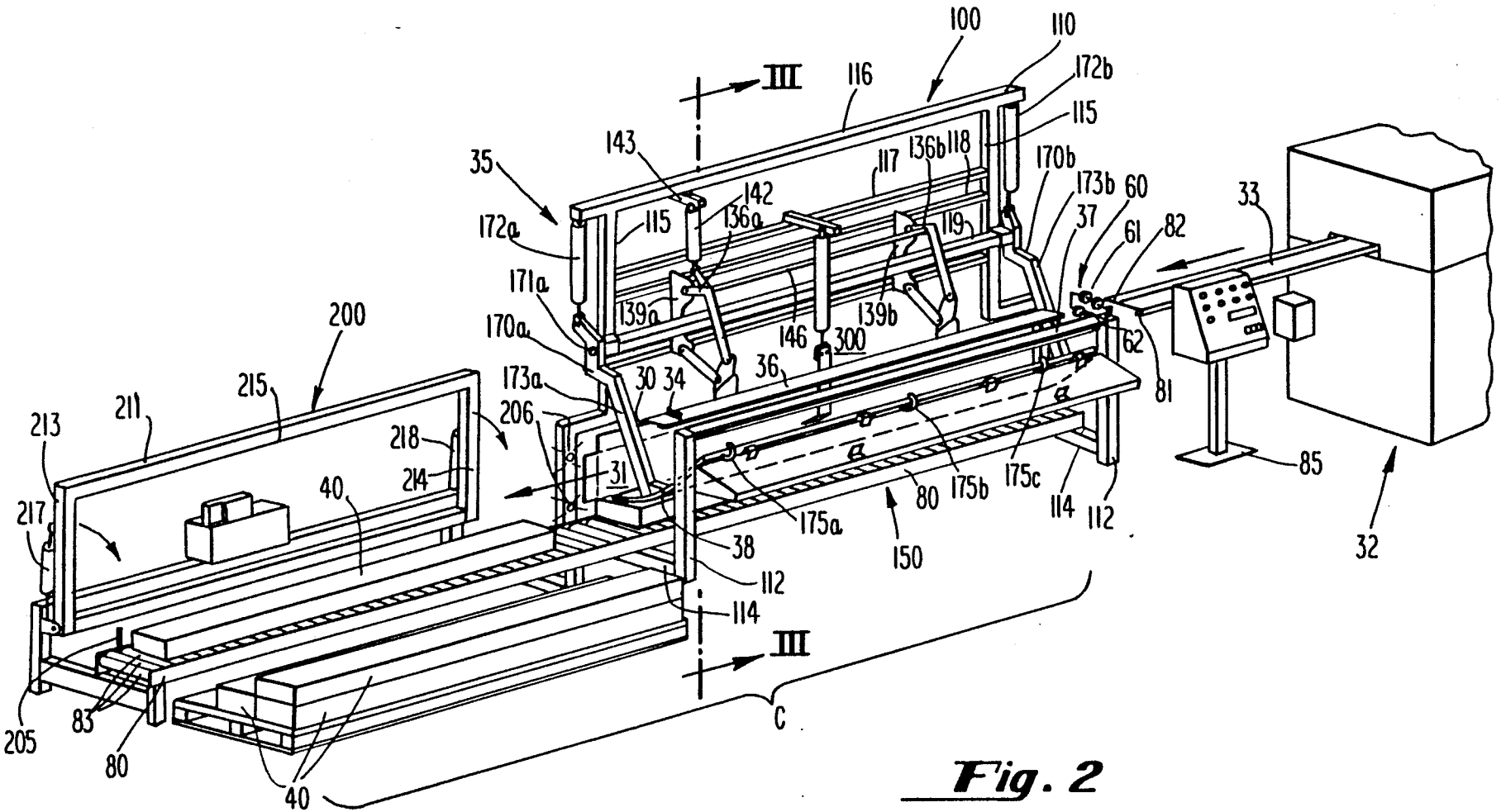
FIG. 2 shows a perspective view of the panel packer and container closer.

FIG. 2 shows a perspective view of area C, where the panel packer/container closer 35 is shown to have a panel container storage/feeder station 300, a panel packer station 100 with a powered conveyor 80, as is known, running into a container closer station 200 to automatically move a filled container from station 100 to station 200. The extrusion operations, consisting of extruding the vinyl panels in the desired shape, forging and sizing said panels and cutting the panels to the appropriate size, are designated as 32. In FIG. 2, a panel 33 having a butt edge 81 and an oppositely disposed, straight or knifelike, hanger edge 82 is shown being emitted from the slicer in the extrusion operations 32, just prior to being picked up by speed-up rollers 60. A control panel for operator command of electrical and vacuum systems (wiring and tubing not shown), master power off and the computer control program is designated as 85. All of these major components, i.e. the extrusion operations 32, the control module 85, the panel packer 100 and the container closer 200, are firmly bolted to the floor of the factory as is known.

The panel packer station 100 has a rigid frame made of rectangular steel tubing that consists of a rear framework 110 and a front framework 112 being joined, as by welding or other known means, by lower spanning braces 114 As can be seen, braces 114 are approximately level with the floor that station 100 is bolted to and provide a base for conveyor 80. This combines to present a very low center of gravity to station 100 so that the operations, as will be described, that take place thereon do not jar or tilt the station and conveyor 80 is comprised of an electric motor (not shown) connected to an appropriate gear train (not shown) to power a series of connected rollers 83. Rear framework 110 is comprised of a pair of oppositely disposed, vertical braces 115 joined at various heights by horizontal bracing, such as at 116, 117, 118, and 119 in the same manner as previously described. Station 100 has three major subcomponents that receive panels 33, orient them to the proper position and collect and store them inside a waiting, lid-open container 30. The three major subcomponents are a panel receiving area or upper tray 36; a panel inverter bar 37; and the panel packer cradle 38. These major subcomponents are described below and can be seen more clearly in FIG. 3, which is a cross-sectional view taken along lines III-III of FIG. 2. As the continuous line of siding is formed in the extrusion operations 32, the lead end of panel 33 (as shown by the arrow in FIG. 2) enters speed-up rollers 60. Rollers 60, in the form of electrically-operated, top and bottom roller wheels 61, 62, wheel 62 appropriately connected to drive gears which rotate at a known speed, accept the lead end of panel 33 and slip over the upper and lower surfaces of the panel until the appropriate length is cut away by the extrusion slicer (not shown). Once panel 33 is free from the extrusion operations, wheels 61, 62 grip the upper and lower surfaces of panel 33 and accelerate panel 33, at a faster, pre-determined rate to move it to a movable stop 34 on tray 36 and thereby provide an amount of spacing between consecutive panels that allows station 100 to manipulate and re-orient a panel as required.

Container storage and transfer section 300 (as shown partially in FIG. 3 and more fully in FIG. 3*a*) comprises a platform 303 to hold stacks of containers 20 for consecutive feeding by a pair of Miller cylinder actuated arms 305*a,b* (only 305*b* shown in FIGS. 3 and 3*a*) having right-angle hooks 307*a,b*, respectively, (only 307*b* shown) attached at their distil ends thereof. Hooks 307*a,b*, from a starting position, releasably contact an empty container 20 that is at the bottom of the stack and move it into position under the trailing edge of cradle 38. When arms 305 reciprocate to the starting position to perform the same movement, as required, gravity-operated, anti-backup stops prevent the remaining containers from backward movement.

Figure 3:
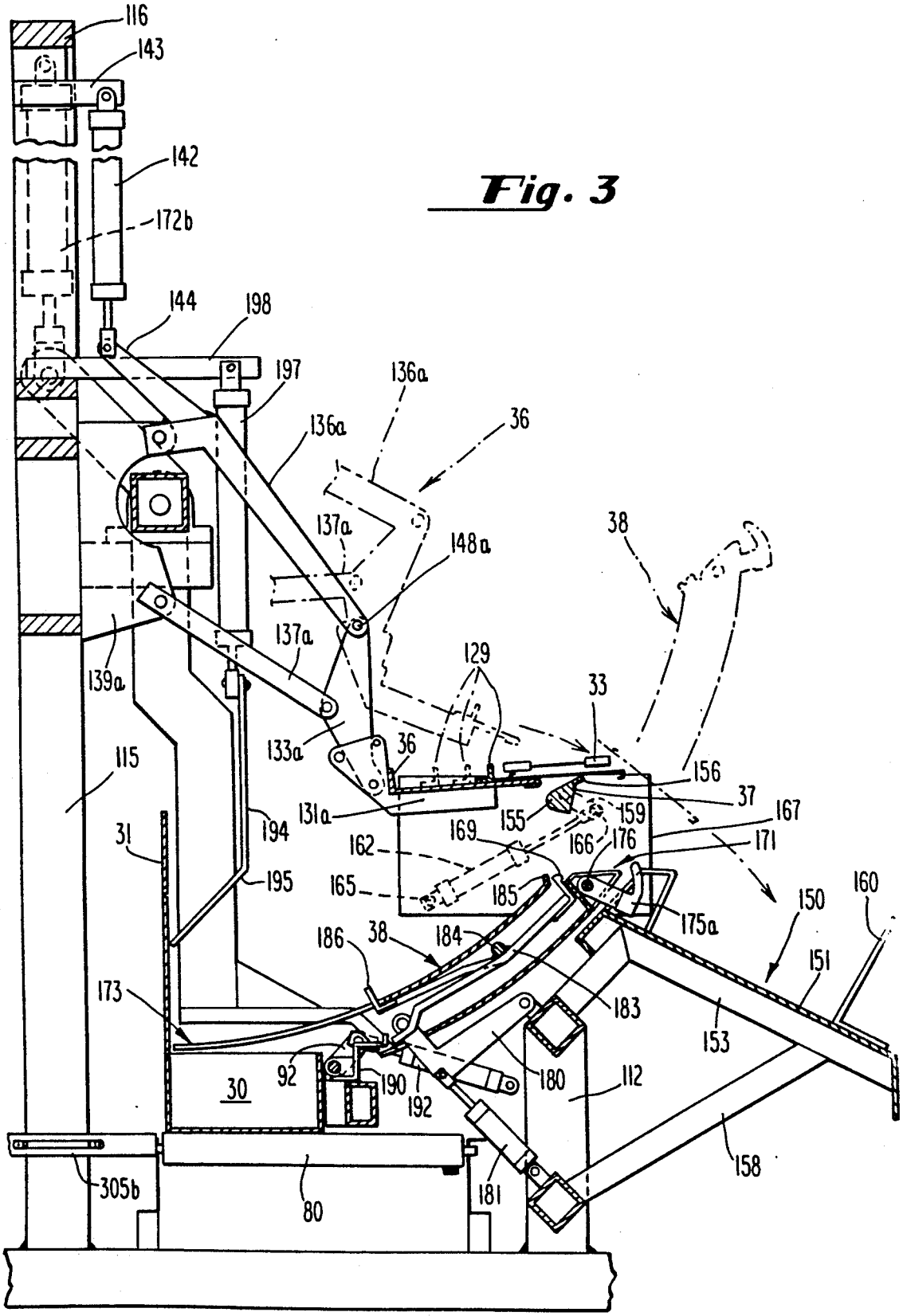
FIG. 3 shows a cross-sectional view of the panel packer taken along lines III-III of FIG. 2.

FIG. 3 shows a panel 33 has entered the panel receiving area or upper tray 36. Upper tray 36 is comprised of a flat, elongated, rectangular sheet with a front and back edge of sturdy, stainless steel or similar material held in a predetermined location, as will be explained, adjacent speed-up rollers 60. Moveable backstops 129 and 34 are adjustable on the upper surface of tray 36 in accordance with the width and length of individual panels that are being processed on a particular line. Upper tray 36 is moveably held by a pair of "L" shaped flanges 131*a* and 131*b*, (only 131*a* shown in FIG. 3) which flanges are, in a similar manner, affixed to triangular shaped pieces 133*a*, 133*b* (133*b* not shown in FIG. 3). Individual links 136*a* and *b*, and 137*a* and *b* (only 136*a*, 137*a* shown in FIG. 3) are pivotably connected to triangular pieces 133*a*, 133*b*, respectively, which links pnuematically actuated Miller cylinder 142 is anchored at its one end to bar 143, which is firmly secured to bracing 116, and connected at its other end to an extension link 144 from link 136*a*. This combination is connected, via crossbar 146, to link 136*b* (see FIG. 2) and is pivotable at joints 148*a,b* and 149*a,b* such that when cylinder 142 is activated, upper tray 36 can assume any one of three possible positions as controlled. Tray 36 can (1) position panel 33 in a horizontal position with the hanger edge 82 at a slightly lower point than butt edge 81 to allow inverter bar 37 to make turning contact therein (as will be explained); (2) position a second panel such that butt edge 81 can be grasped by fingers 175 on cradle 38 (as will be described); or (3) as shown in phantom outline, raise the back edge up to allow a panel 33 that should be rejected to be diverted and allowed to fall by gravity into a catch area 150 in front of the panel packer station 100 (as shown by the phantom arrows and lines). Catch area 150 is a second, elongated and rectangular flat area 151 securely held by framework extension 153 and 158 and which has a backstop 160 mounted thereon.

The inverter bar 37 has a substantially triangular shaped cross-section and it pivots about an axis made by connector pins through the top ends of oppositely disposed posts 112. As seen in FIG. 3, bar 37, on its upper surface 155 extends out into a lip 156. Lip 156 is conveniently sized to a proper thickness to be removeably inserted inside the "J" hook on butt end 81 of a panel 33. Bar 37 has an extension 159 attached between a Miller cylinder 162, as previously described, which reciprocally forces the rotation of lip 156, and a panel caught thereon, through an arc of approximately 150°. Cylinder 162 and the respective anchoring bolts 165 and 166 are all maintained inside housing 167.

Panel packer station 100 uses a cradle 38 pivotably carried by a pair of reciprocally rotatable and oppositely disposed arms 170, as shown in FIG. 2 to make the desired combinations of panels. Arms 170*a, b* are rotatably joined, as by pins 171*a, b* (171*b* not shown) and have Miller cylinders 172*a, b* joined therebetween and bar 116 and long extensions 173 *a, b* connected to cradle 38. Cradle 38 comprises a rectangular shaped, curvilinear, panel-receiving surface wide enough and long enough to provide support to any one of a variety of panels 33 that are emitted from the extrusion line 32 and reciprocates from a "down" position to an "up" position, as will be explained. Cradle 38 has a leading edge 171 and a trailing edge 173.

As can be seen, trailing edge 173, when cradle 38 is in its "down" position, occupies the space immediately over an open container 30. At leading edge 171 are a plurality of gripping fingers 175*a, b, c* that rotate about an elongated bar 176. Fingers 175 are activated from their non-gripping mode (as shown in FIG. 3) to their panel gripping mode (as shown in FIG. 3 *c*) by a Miller cylinder 178 connected to a chain and pulley mechanism 179 carried underneath the panel catching surface. Cradle 38 also carries a lever mechanism underneath its surface area that provides a panel holding positive control over a panel or panel combinations and that also provides a panel release lifter that separates a panel combination therefrom at the proper time. These functions are accomplished by the arrangement of an "L" shaped bracket 180 pivotally fixed to the front post 112 at an end thereof and pivotally connected to a Miller cylinder 181 at its corner. At the end of the short leg of the "L" shaped bracket 180 is attached a link of prespecified dimensions that is pivotable about pin 184. At the upper end of link 183 stands a right-angle shaped bracket 169 that serves as a panel combination release lifter to physically push a panel combination away from the leading edge 185 of cradle 38 at the appropriate time. Leading edge 185 is offset at a slight angle to provide a holding surface for the panel combination, as will be explained. Also extending from pin 184 are panel release fingers 186 which serve to keep a panel in a predetermined spot on the cradle surface. When panel release lifter 169 forces the panel combination off of the top lift 185 of cradle 38, panel release fingers 186 move underneath the surface of cradle 38, through pre-cut and pre-sized apertures therein, and allow the panel combination to slide down to the trailing edge 173, ready to be packed into container 30.

Station 100 also carries a plurality of anti-back-up fingers 190 in the form of double right angles connected together that are rotatably controlled by cylinder 192 and bar combination to rotate from a hidden (as shown in FIG. 3) to an extended position at the proper time. Appropriately sized sections are cut out of the surface of cradle 38 to allow anti-back-up fingers 190 to emerge therethrough.

Prior to a container being moved underneath trailing edge 173*a*, container cover lifting device 194 is reciprocally mounted at the back of framework 110 to insert a cover lift bar 195 into the space between the unsecured lid 31 and container 30 as container 30 is pushed into the space underneath trailing edge 173. A pneumatic Miller cylinder 197 anchored to crossbar 198 provides the motion for the coverlift 195, and is sequentially controlled to operate at the appropriate time, as are all other Miller cylinders, as determined by the control program.

Figure 3A:
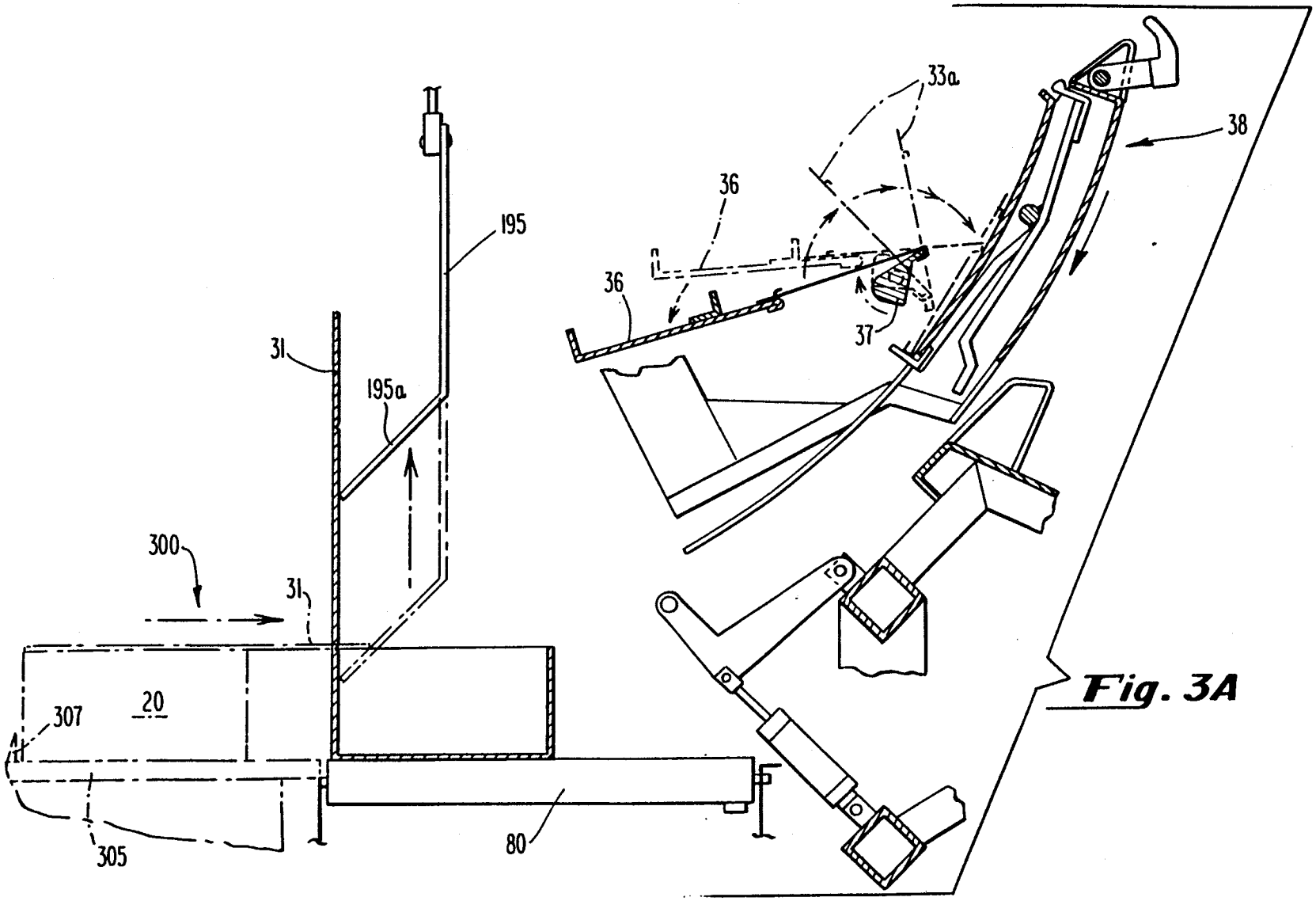
FIG. 3*a* shows, schematically, an empty container (in phantom) being positioned to receive panels and the panel packer receiving and inverting the first panel of a two-panel combination.

The motions and sequence of operations of the panel packer station 100 will now be described with reference particularly to FIGS. 3*a* through 3*f*. As shown in FIG. 3*a*, station 100 receives a lid open container 20 through the open area in rear framework 110 as by arms 305 and as container 20 is moved into the holding area, the coverlift bar 195 is reciprocated up and hook end 195*a* catches on lid 31 and straightens it to a vertical orientation. Control program 85 has a timing sequence in it and a sensor that senses a panel 33 being issued from the extrusion operations 32 and starts a timer in program 85. Panel 33 is moved into the holding area of upper tray 36 and the rear edge of tray 36 is lowered (as shown by the phantom outline and the arrow in FIG. 3*a*) so that the lip 156 of inverter bar 37 catches into the butt end 81 of the panel. Cylinder 162 is actuated and the panel 33*a*, as shown by the panel in phantom outline, is flipped over, or inverted, to a second orientation. Simultaneously, as inverter bar 37 is reorienting panel 33*a*, cradle 38 is being moved from a first, lower position in a first arc of approximately 90 degrees to a first, upper position by arms 170. After panel 3*a* has come to rest against the upper surface area of cradle 38, in its initial cradle position, cradle 38 starts back down to its firstpanel rest position, as shown by the arrow.

Figure 3B:
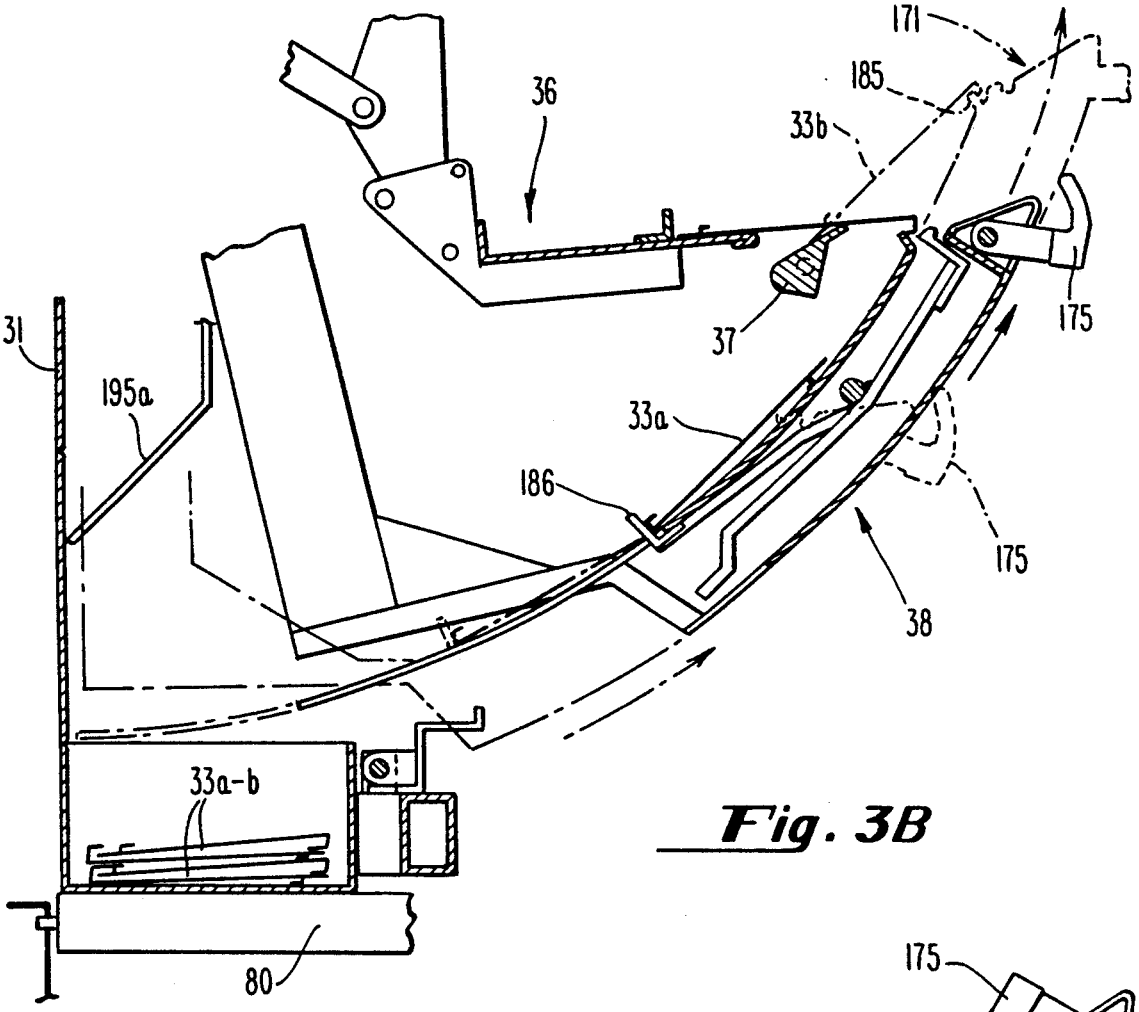
FIG. 3*b* shows, schematically, the cradle and first panel moving into a holding relation with the second panel.
Figure 3C:
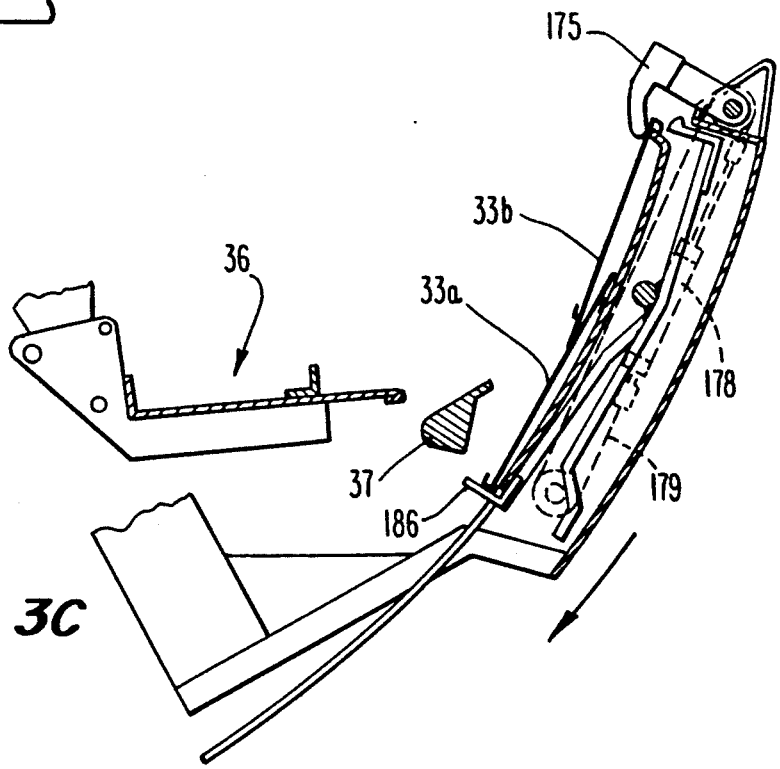
FIG. 3*c* shows, schematically, the cradle fingers holding a twopanel combination.

As seen in FIG. 3*b*, a sensor senses that first panel 33*a* has cleared the tray holding area 36 and a second panel 33*b* is now moved into said holding area. This sends a signal to cylinders 172*a, b* firing cradle arms 170*a, b* and cradle 38 begins a second trip through a ninety degree arc from its lower position to its upper position. (In FIG. 3*b*, it is shown that as trailing edge 173 of cradle 38 leaves the space immediately above container 30, there are several panel combinations 33*a–b* sitting inside of container 30.) As cradle 38 rises to the top of the second arc, as shown by the phantom outline in FIG. 3*b*, first panel 33*a* is held by brackets 186 and second panel 33*b* is caught by the tip edge 185 and dragged up to the top of the arc. This motion actuates a signal that activates cylinder 178 and causes gripping fingers 175 to rotate over to a position that catches the butt edge of second panel 33*b* against the tip 185. At this point in the operations, a two-panel combination is starting to be formed. With certain styles of panel, it may not be necessary to use gripping fingers 175 because the panels are wide, and therefore, heavy, enough to stay in their initial position on cradle 38.

Figure 3D:
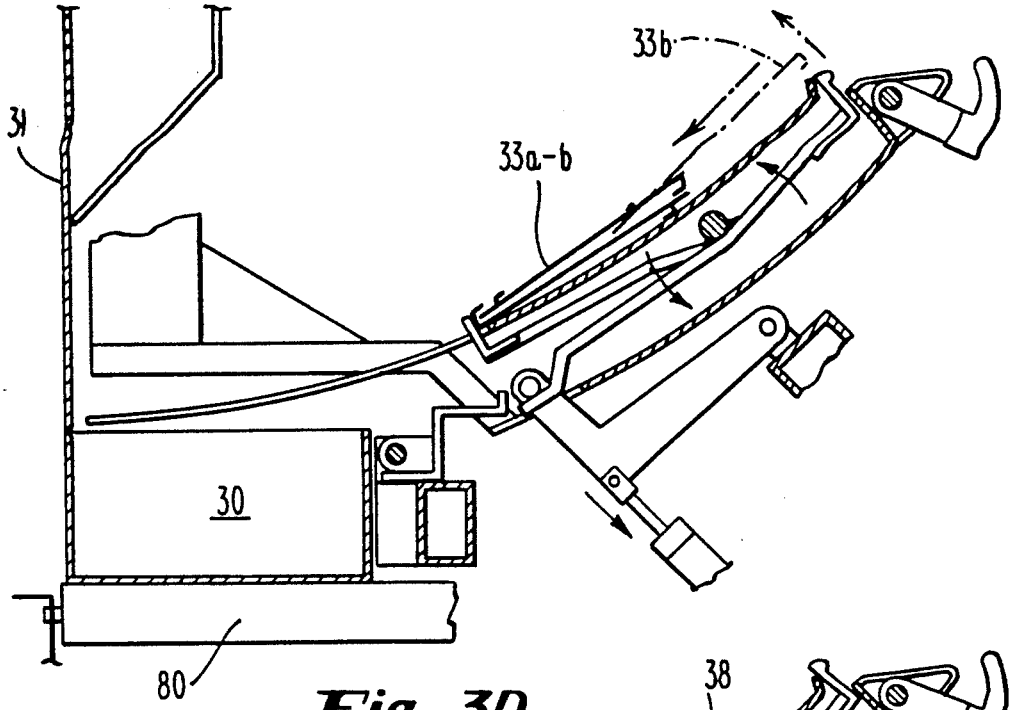
FIG. 3*d* shows, schematically, the adjusting of the butt end of the second panel (in phantom) to achieve a two-panel combination resting against panel release fingers.
Figure 3E:
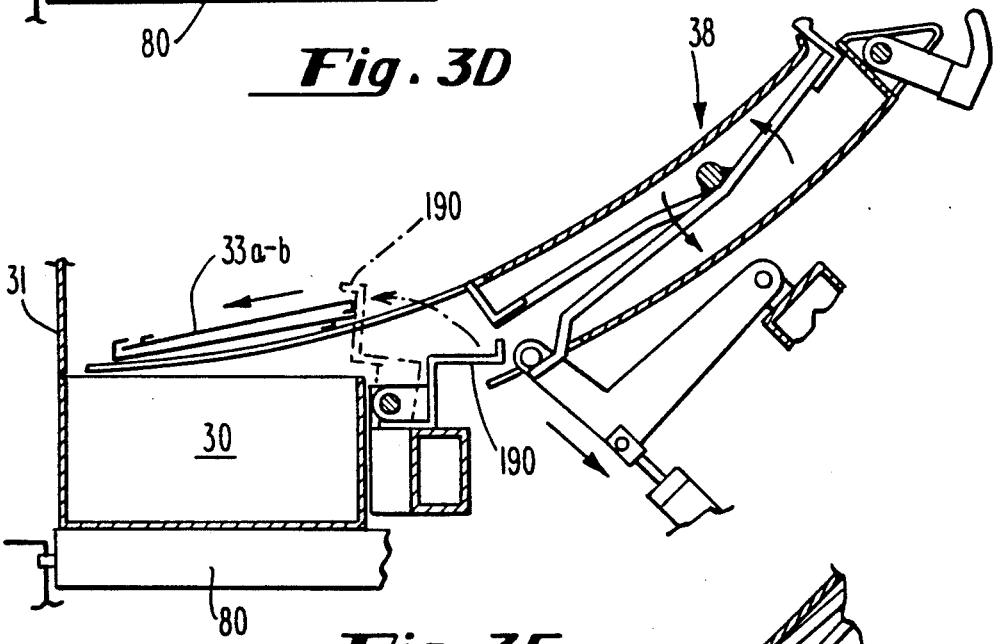
FIG. 3*e* shows, schematically, the two-panel combination on the trailing edge of the cradle and the antiback-up strippers moving from their retracted to their extended position.
Figure 3F:
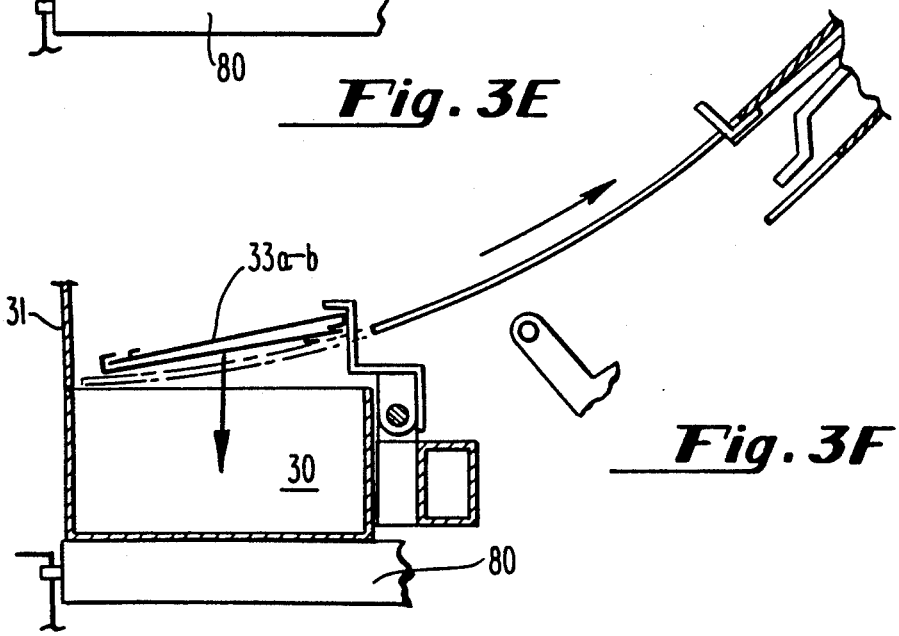
FIG. 3*f* shows, schematically, the two-panel combination being forced into an open container by the antiback-up strippers as the cradle moves out of the space over the container.

As shown in FIG. 3*d*, fingers 175 release from panel 33*b* and edge release mechanism 169 is rotated forward, thereby bumping the butt edge of second panel 33*b* from the top of tip 185 and allowing it to fall under the force of gravity to rest against panel release fingers 186 adjacent first panel 33*a*. A further activation of cylinder 181 causes release fingers 186 to rotate underneath the surface of cradle 38 and the panel combination 33*a–b* now slides down to a spot adjacent and immediately over trailing edge 173 of cradle 38. Anti-back-up fingers 190 rotate up through the apertures in the surface of cradle 38 and cradle 38 starts back up in its first arc, as shown by the arrow in FIG. 3*f*, to pick up a new panel Anti-back-up fingers 190 prevent panel combination 33*a–b* from moving therewith and the combination settles into container 30.

After a container 30 has been loaded with the proper number of panel combinations 33*a–b*, a signal counter in the control program starts in motion several functions: a sensor 205 (as seen in FIG. 2) detects whether a closed container 40 is awaiting pickup by the palletizer 51 and if so does not allow conveyor 80 to move; however, if the sensor does not detect a waiting container then conveyor 80 starts in motion thereby starting the filled container out of station 100. A second sensor 206 detects when the lid 31 of container 30 passes thereby and a hot melt glue gun, in the same manner as previously described, applies a spray of hot melt glue to the inside surface of panel e as container 30 is moved from the panel pacer station 100 onto the closer station 200. Once sensor 205 senses that the container has arrived, a pair of oscillating glue guns apply prespecified amounts of hot melt glue to the left and right end flaps, L, R, respectively of section d. After all surfaces have received the proper amount of hot melt glue, a rectangular tray closer 211 is pivotally lowered to surround container 30. As framework 211 is lowered around the lid of the container, the side bars 213, 214 and the forward bar 215 force the remaining flaps of the lid 31 to conform to the size and shape of the container. At this point, a timer is set to run and inflatable compression bags on the inside surfaces of framework 213, 214 and 215 inflate to force the flaps against the box of the container and thereby sealing the lid of the container to the box. After an appropriate amount of time, as determined by the timer, the inflatable bags are deflated and framework 211 is rotated back to its upright position by a pair of Miller cylinders 217, 218. An electric scale makes contact with the underside of container 40 and lifts container 40 a slight amount away from the rollers of conveyor 80 and thereby determines the weight of container 40.

The final area D of the packaging system, as seen in FIG. 1, is a palletizing machine 50. Palletizing machine 50 is comprised of a palletizer 51, that has a travel module and a control module, that travels along a railing system 53 that stretches overhead of all panel packer/-tray closer lines (only one such line shown in FIG. 1). The electrical and vacuum servicing are identical as with the other machines in the packaging system and palletizer 51 has a plurality of vacuum suction cups 56 that extend from the lower surface thereof After loaded container 40 has been completely closed and weighed, a service call is electronically sent to palletizer 51. Selected information, such as which packer/closer line 35 has the highest priority, what type of panel combination 33*a–b* has been packed in the closed and glued container 40 awaiting palletizing and how that particular container should be oriented (i.e. upright, on its side, or inverted) on a pallet 41, is also communicated to palletizer 51. Also included in this information are container pick-up coordinates, container place coordinates, and the request for a slip sheet, if one is required to be placed between stacks of containers on a pallet. The container closer station 200 of panel packer/container closer machine 35 will procede to weigh and orient a closed container 40 as palletizer 51 moves to the proper location. When station 200 has finished orienting the loaded container, it will send a signal that turns on an emitter portion of a photo electric emitter/receiver pair. When the palletizer's receiver senses that the container closer has completed orienting the loaded container 40, palletizer 51 proceeds to the proper line to pick up and place the container. The vacuum pump starts evacuating the vacuum reservoir and a vacuum platen movable in the vertical direction with a plurality of cups 56 is lowered until cups 56 are resting on the container. Switches are deenergized and the opening between vacuum cups 56 and the reservoir is cleared drawing a vacuum on a container 40. Palletizer 51 now draws container 40 up vertically to a predetermined height and then moves on a predetermined horizontal plane to a pallet location 41. Container 40 is slowly lowered until a compliance limit switch senses that it has been placed in a predesignated location on pallet 41. At this time, palletizer 51 transmits a selected message electronically to the panel packer/container closer 35 to complete this cycle. When a preselected number of loaded containers 40 have been placed in proper stacking sequence on pallet 41, palletizer 51 is instructed to move to a predesignated area where slip sheets are contained and draw a vacuum between the suction cups 56 and one of these slip sheets to bring it, if needed, to the top of the stack of containers. The slip sheet sets the base surface for the next arrangement of a predetermined number of loaded containers 40 and palletizer 51 is redirected, according to the control program.

These and other variations in the details of the packaging system may be made in accordance with the invention, which is to be broadly construed and is to be defined by the scope of the claims appended hereto.

What we claim is:

1. A method for sequentially receiving extruded vinyl panels, re-orienting selected panels, combining panels pairs and packing the pairs in a waiting container, comprising the steps of:

(a) receiving a first panel in a horizontal orientation;
(b) transposing said first panel to a first orientation and depositing said first panel on an adjacent and movable surface;
(c) receiving a second panel in a horizontal orientation;
(d) transposing said second panel to a second orientation and depositing said second panel in a predetermined position adjacent said first panel to form a combination therewith;
(e) moving the combination of said first and second panels into a container; and
(f) repeating steps a through e until a predetermined number of panel combinations have been moved into said container.

2. A method of packaging extruded vinyl panels in a container, comprising the steps of:

(a) receiving a first panel in a horizontal orientation;
(b) transposing said first panel to a first orientation and depositing said first panel on an adjacent and movable surface;
(c) receiving a second panel in a horizontal orientation;
(d) transposing said second panel to a second orientation and depositing said second panel in a predetermined position adjacent said first panel to form a panel pair combination therewith;
(e) moving the panel pair combination into a prefolded and formed container; and
(f) repeating steps a through e until a pre-determined number of panel pair combinations have been moved into said pre-folded and formed container.

* * * * *

UNITED STATES PATENT OFFICE

CERTIFICATE OF CORRECTION

Patent No. 5,024,045 Dated June 18, 1991

Inventor(s) Stewart L. Fluent et al.

It is certified that error appears in the above-identified patent and that said Letters Patent is hereby corrected as shown below:

In column 4, line 66, delete --forging-- and insert therefore "forming".

In column 6, line 14, after the words "which links" insert the words "are joined to the rear framework by flanges 139a, 139b. A".

Signed and Sealed this

Thirteenth Day of October, 1992

*Attest:*

DOUGLAS B. COMER

*Attesting Officer*

*Acting Commissioner of Patents and Trademarks*